US011401009B2

(12) United States Patent
Shearer

(10) Patent No.: US 11,401,009 B2
(45) Date of Patent: Aug. 2, 2022

(54) LATERAL ARM ACTUATOR FOR EXTENDABLE AWNING

(71) Applicant: Taylor Made Group, LLC, Gloversville, NY (US)

(72) Inventor: Robert R. Shearer, Bradenton, FL (US)

(73) Assignee: Taylor Made Group, LLC, Gloversville, NY (US)

( * ) Notice: Subject to any disclaimer, the term of this patent is extended or adjusted under 35 U.S.C. 154(b) by 509 days.

(21) Appl. No.: 16/596,991

(22) Filed: Oct. 9, 2019

(65) Prior Publication Data

US 2020/0108897 A1 Apr. 9, 2020

Related U.S. Application Data

(60) Provisional application No. 62/743,043, filed on Oct. 9, 2018.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361
See application file for complete search history.

(56) References Cited

U.S. PATENT DOCUMENTS

| | | | | |
|---|---|---|---|---|
| 6,971,433 | B2 | 12/2005 | Wagner et al. | |
| 7,073,555 | B2 | 7/2006 | Weddell | |
| 7,073,556 | B2 | 7/2006 | Weddell et al. | |
| 7,101,363 | B2 * | 9/2006 | Nishizawa | A61B 34/71 606/1 |
| 7,568,491 | B2 | 8/2009 | Banfill et al. | |
| 9,068,628 | B2 * | 6/2015 | Solomon | A61B 34/71 |
| 9,228,359 | B2 | 1/2016 | Taylor | |
| 9,371,652 | B2 | 6/2016 | Malott | |
| 9,695,635 | B2 | 7/2017 | Taylor et al. | |
| 9,755,408 | B2 | 9/2017 | Taylor | |
| 9,862,461 | B2 | 1/2018 | Cao | |

* cited by examiner

*Primary Examiner* — Lars A Olson
(74) *Attorney, Agent, or Firm* — Nixon & Vanderhye P.C.

(57) ABSTRACT

A lateral arm actuator for an extendable awning includes a gas spring with a cylinder and a rod that is displaceable relative to the cylinder, a fitting disposed at a distal end of the rod, and an awning knuckle including a first connector coupled to a cylinder end of the gas spring, a second connector, and a pivot coupled between the first and second connectors. The second connector is pivotable relative to the first connector, and the second connector includes a hook. A cable formed into a continuous loop is positioned over the fitting, along the gas spring, and across the awning knuckle engaging the hook. An extendable awning assembly also incorporates the lateral arm actuator to extend and retract the awning via a motorized roller.

14 Claims, 6 Drawing Sheets

LATERAL ARM ACTUATOR FOR EXTENDABLE AWNING

CROSS-REFERENCES TO RELATED APPLICATIONS

This application claims the benefit of U.S. Provisional Patent Application No. 62/743,043, filed Oct. 9, 2018, the entire content of which is herein incorporated by reference.

STATEMENT REGARDING FEDERALLY SPONSORED RESEARCH OR DEVELOPMENT (Not Applicable)

BACKGROUND

The invention relates to an extendable awning and, more particularly, to a lateral arm actuator for an extendable awning that incorporates a gas spring.

Extendable awnings have various applications including, for example, in a marine environment where an extendable awning may serve to provide shade or like for an area of a boat cabin that is typically uncovered. Existing lateral arm awnings typically use a traction gas spring or the like attaching the center joint with the joint closest to the awning fastening mount. This requires multiple actuating cables/straps/chains, etc. for various arm lengths. Additionally, the use of traction gas shocks results in higher costs for parts and manufacturing.

SUMMARY

The lateral arm actuator of the described embodiments utilizes a self-contained extension gas shock/spring that connects to the center arm joint. The assembly utilizes only one cable/strap/chain length required for any length awning arm.

In an exemplary embodiment, a lateral arm actuator for an extendable awning includes a gas spring with a cylinder and a rod that is displaceable relative to the cylinder, a fitting disposed at a distal end of the rod, and an awning knuckle including a first connector coupled to a cylinder end of the gas spring, a second connector, and a pivot coupled between the first and second connectors. The second connector is pivotable relative to the first connector, and the second connector includes a hook. A cable formed into a continuous loop is positioned over the fitting, along the gas spring, and across the awning knuckle engaging the hook.

The rod may be biased toward an extended position. The fitting may include a groove, where the cable may be disposed in the groove. The cable may be inelastic. The second connector may be pivotable relative to the first connector across about 165°.

In another exemplary embodiment, an extendable awning assembly includes a motorized roller, an extension bar, an awning secured between the motorized roller and the extension bar, and an extension arm assembly coupled with the extension bar. The extension arm assembly includes a first pivot arm pivotably connected to a second pivot arm and the lateral arm actuator of the described embodiments disposed between the first and second pivot arms. The first pivot arm is secured to the first connector of the lateral arm actuator assembly, and the second pivot arm is secured to the second connector of the lateral arm actuator assembly.

The extendable awning assembly may include at least two extension arm assemblies acting on the extension bar. The assembly may further include a pair of base support brackets attachable to a structure, where the motorized roller is connected between the base support brackets. The first pivot arms of each of the extension arm assemblies may be pivotably connected to a respective one of the base support brackets.

With the rod biased toward an extended position, the extendable awning assembly may be configured such that the awning in a stowed position maintains the extension arm assembly in a retracted position against the bias of the rod. The extendable awning assembly may be further configured such that activation of the motorized roller in a first direction releases the awning, and the extension arm assembly is displaced toward an extended position by the bias of the rod. The extendable awning assembly may be further configured such that activation of the motorized roller in a second direction opposite from the first direction draws the awning toward the retracted position against the bias of the rod.

BRIEF DESCRIPTION OF THE DRAWINGS

These and other aspects and advantages will be described in detail with reference to the accompanying drawings, in which.

DETAILED DESCRIPTION

Figure 1:
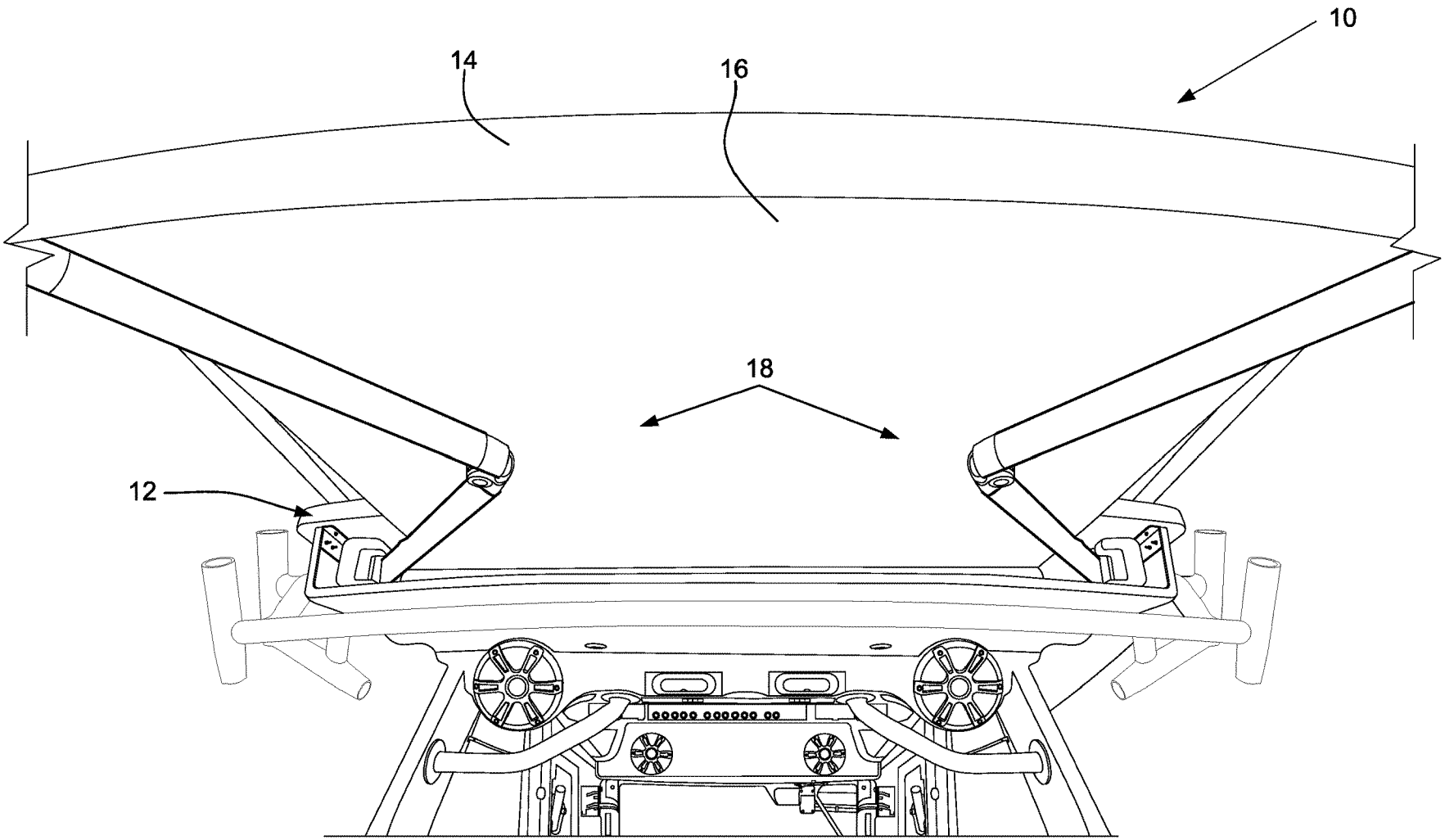
FIG. 1 shows an extendable awning assembly with an extension arm assembly including the lateral arm actuator of the described embodiments.

FIG. 1 shows an extendable awning assembly being displaced to an extended position over a boat cabin. The awning assembly 10 is retractable into a housing 12 forming part of a static boat enclosure or the like. The extendable awning assembly 10 includes an extension bar 14, an awning 16 and an extension arm assembly 18 (two shown) cooperable with the extension bar 14.

Figure 2:
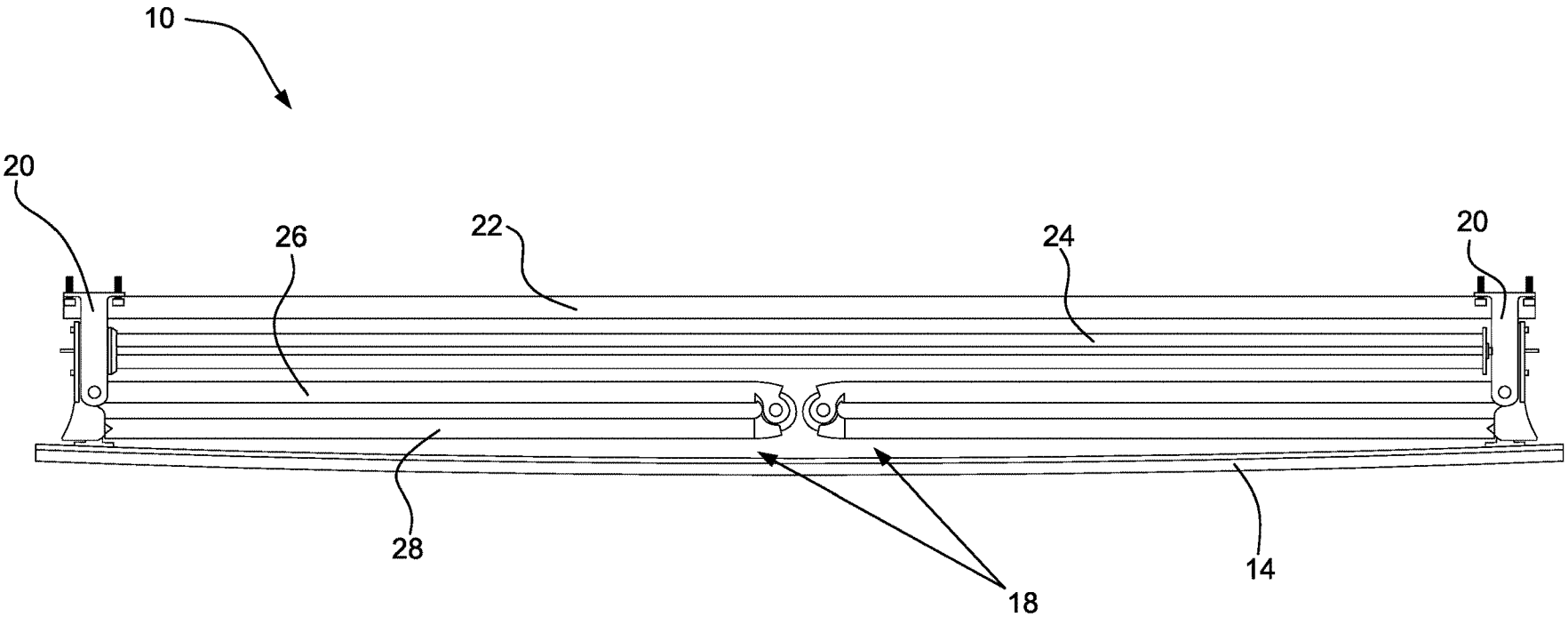
FIG. 2 shows the extendable awning assembly in a retracted position.

FIG. 2 shows the extension awning assembly 10 without the awning 12. A pair of base support brackets 20 are securable to a structure such as the boat enclosure or the like, and a connector bar 22 extends between the base support brackets 20. A motorized roller 24 is rotatably secured between the base support brackets 20. The awning 16 is connected between the motorized roller 24 and the extension bar 14.

Figure 3:
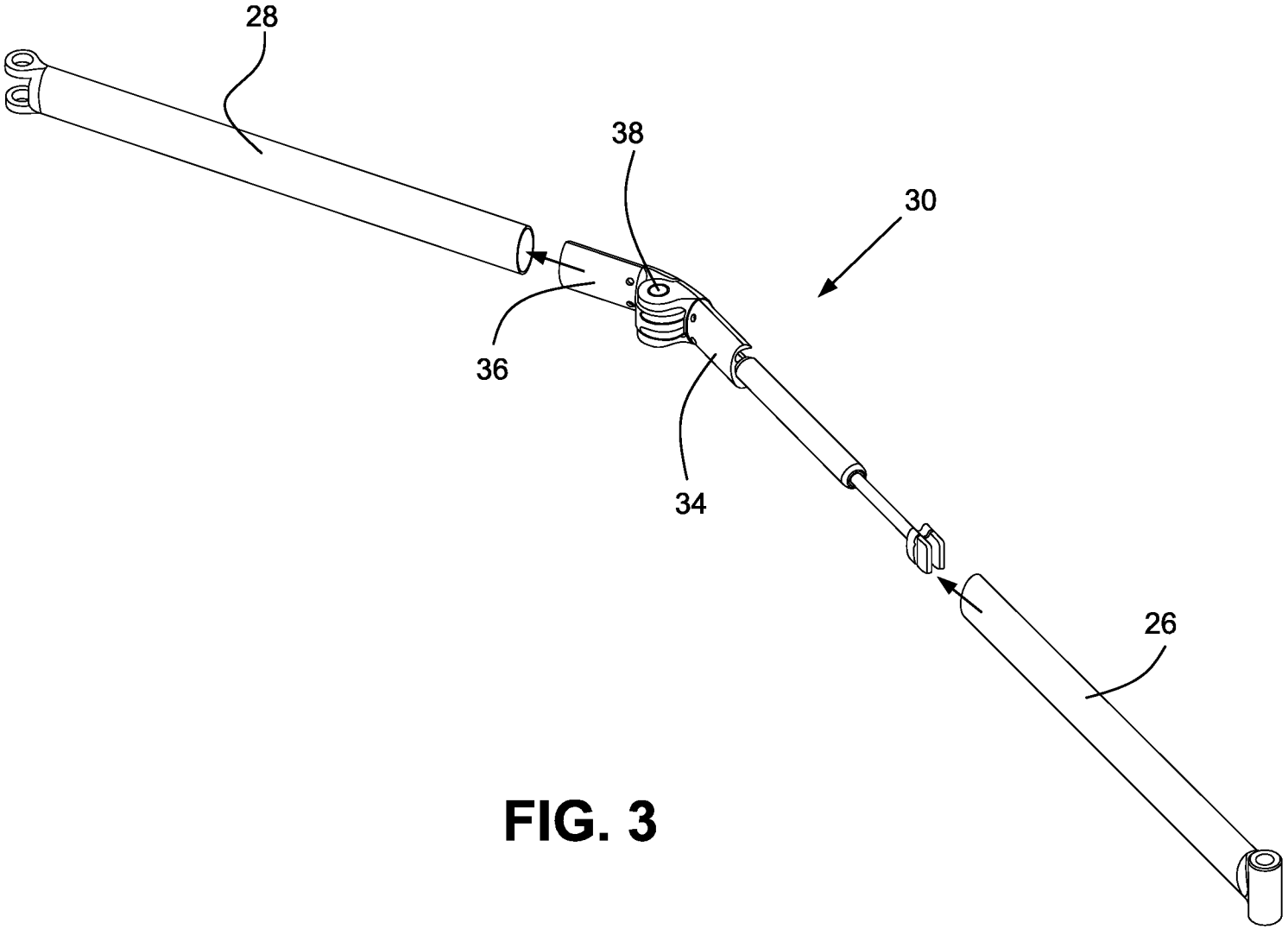
FIG. 3 shows first and second pivot arms connecting to the lateral arm actuator.
Figure 5:
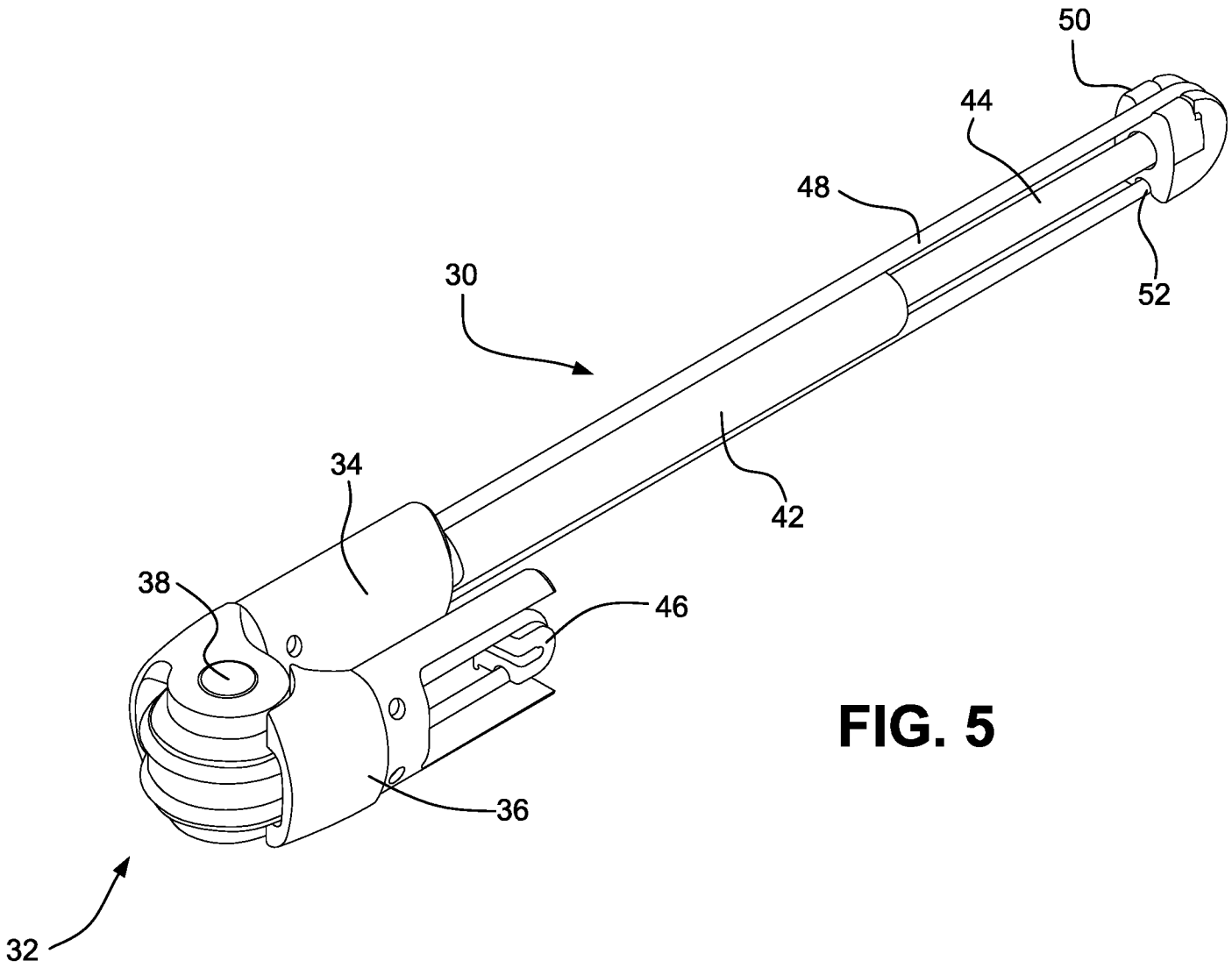
FIGS. 5 and 6 are views of the lateral arm actuator.
Figure 6:
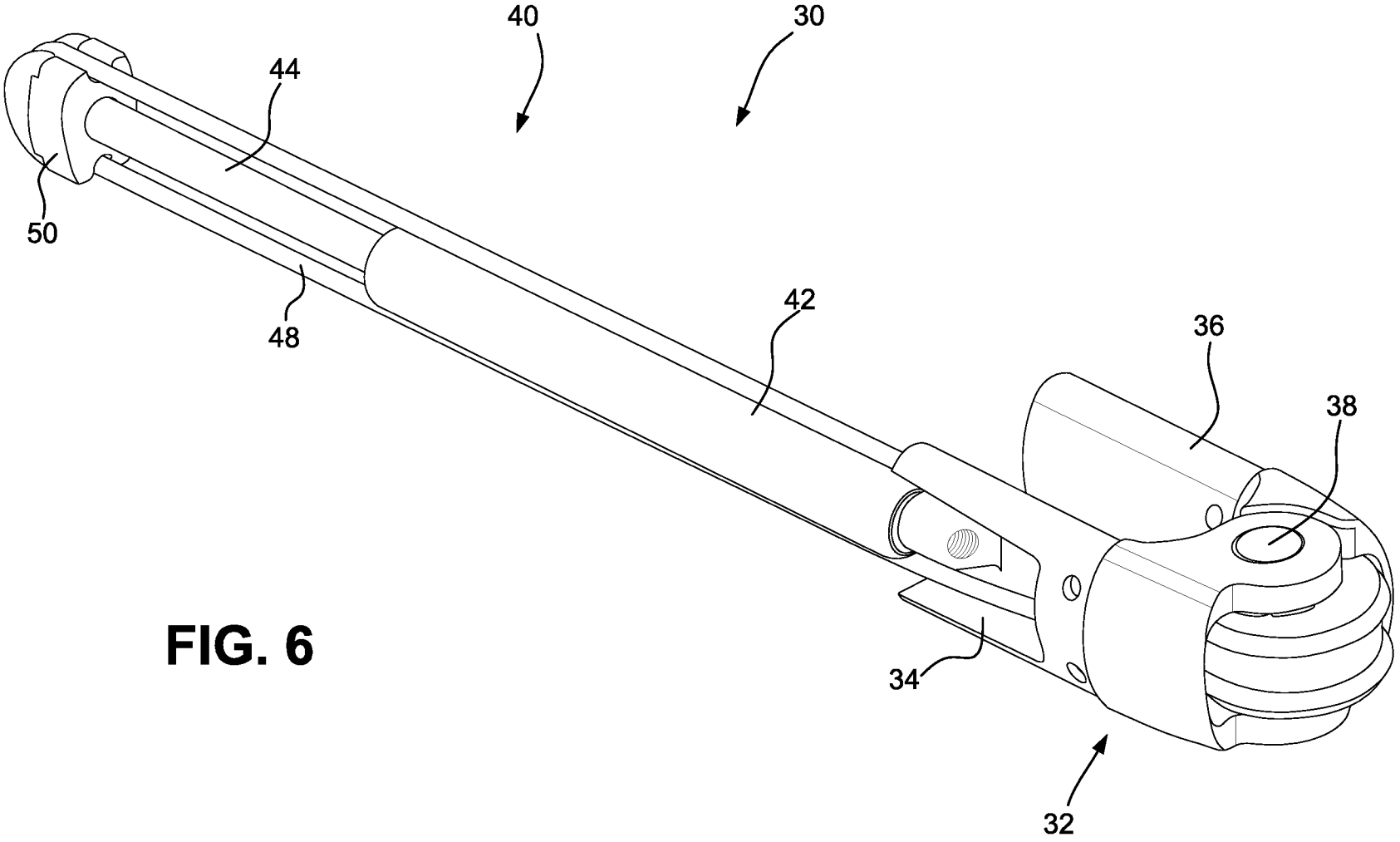

The extendable awning assembly 10 is shown with two extension arm assemblies 18. The awning assembly 10 could have more than two arms. Each of the extension arm assemblies 18 includes a first pivot arm 26 pivotably connected to a second pivot arm 28 via a lateral arm actuator 30 disposed between the first and second pivot arms 26, 28. As shown in FIGS. 3, 5 and 6, the lateral arm actuator 30 includes an awning knuckle 32 with a first connector 34, a second connector 36, and a pivot 38 coupled between the first and second connectors 34, 36. The first and second connectors 34, 36 are pivotable relative to each other. With continued reference to FIG. 3, the first pivot arm 26 is securable to the first connector 34, and the second pivot arm 28 is securable to the second connector 36.

As shown in FIGS. 5 and 6, the lateral arm actuator 30 includes a gas spring 40 with a cylinder 42 and a rod 44 that is displaceable relative to the cylinder 42. In some embodiments, the gas spring 40 is a compression spring such that the rod 44 is biased toward an extended position relative to the cylinder 42. The first connector 34 of the awning knuckle 32 is connected to a cylinder end of the gas spring 40. As shown in FIG. 5, the second connector 36 of the awning knuckle 32 is provided with a hook 46. A cable 48 formed into a continuous loop is positioned over a fitting 50 disposed at a distal end of the rod 44. In some embodiments, the cable 48 is positioned in a groove 52 formed in the fitting 50. The cable 48 is positioned over the fitting 50, along the gas spring and across the awning knuckle 32 engaging the hook 46. In some embodiments, the cable is inelastic. An exemplary cable may be a high strength UHMW (ultra high molecular weight) braided rope, for example, the Dyneema rope manufactured by DSM Corporation. The breaking strength of the Dyneema rope is equivalent or better than that of stainless steel rope. In alternative embodiments, a stainless steel or other metal cable could be used.

Figure 4:
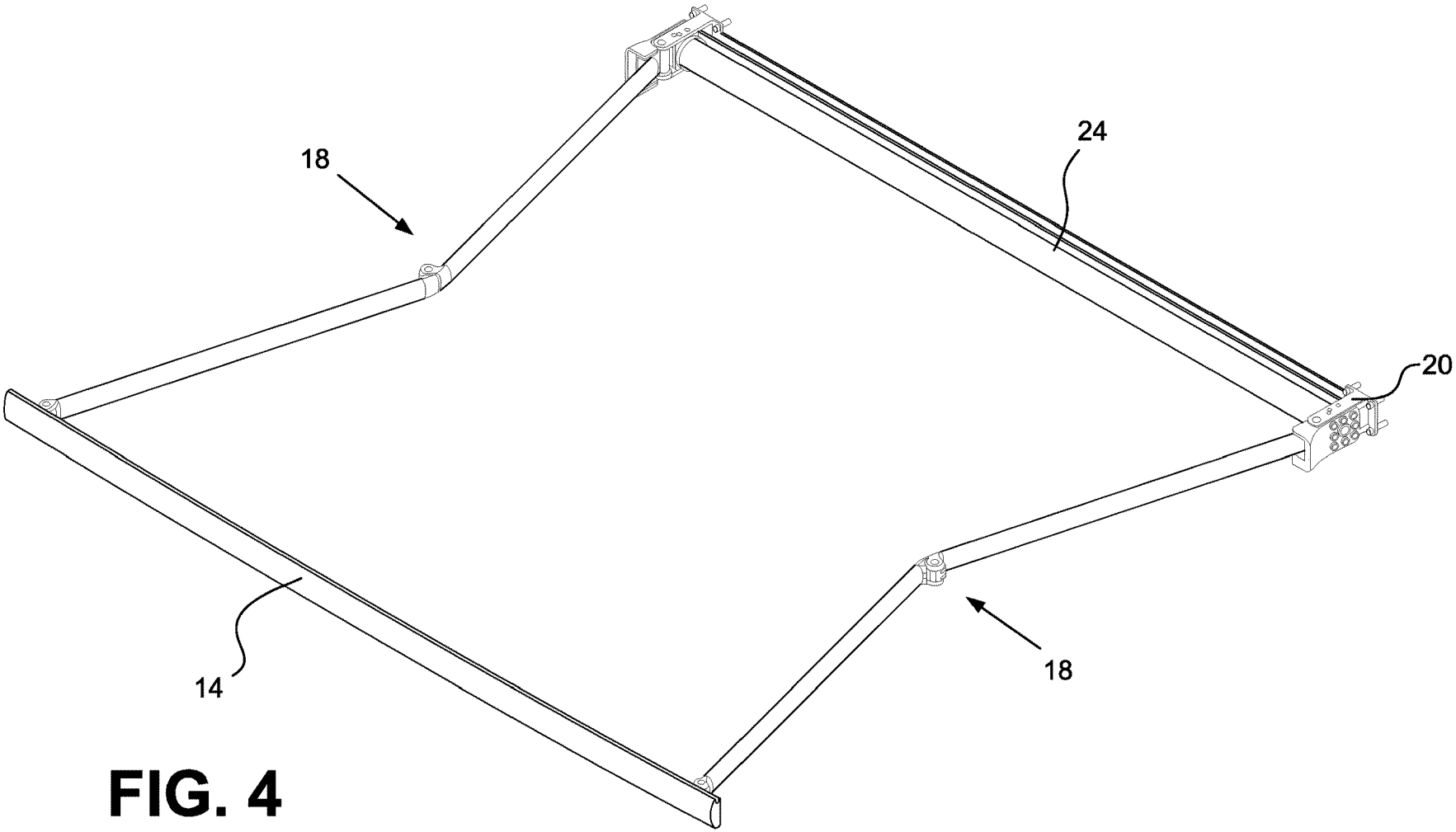
FIG. 4 shows the extendable awning assembly in an extended position.

In use, the assembly creates a torque about the awning knuckle 32 via the extension bias of the rod 44, which biases the extension arm assembly 18 toward the open position shown in FIG. 4. That is, with the awning in a stowed position, the extension arm assembly 18 is maintained in the retracted position against the bias of the gas spring 40. Activation of the motorized roller 24 in an extension direction releases the awning, and the extension arm assembly 18 is displaced toward the extended position by the bias of the gas spring 40.

Activation of the motorized roller 24 in a retraction direction, opposite from the extension direction, draws the awning toward the retracted position against the bias of the gas spring 40. As the first and second pivot arms 26, 28 are bent about the awning knuckle 32, the gas spring 40 compresses while creating an outward biased torque on the awning knuckle 32. The arms 26, 28 are thus forced to bend about the pivot 38 due to the tension of the awning. As the motorized roller 24 is wound towards the retracted position, tension increases within the fabric large enough to overcome the torque of the awning knuckle 32. This causes the pivot arms 26, 28 to retract toward the closed position.

The use of an extension gas shock, as opposed to an traction gas shock, allows for larger forces to be generated for a given gas shock diameter. Also, there is a cost reduction and availability advantage associated with the extension gas shock over the traction gas shock.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A lateral arm actuator for an extendable awning, comprising:

a gas spring including a cylinder and a rod that is displaceable relative to the cylinder;

a fitting disposed at a distal end of the rod;

an awning knuckle including a first connector coupled to a cylinder end of the gas spring, a second connector, and a pivot coupled between the first and second connectors, wherein the second connector is pivotable relative to the first connector, and wherein the second connector includes a hook; and a cable formed into a continuous loop and positioned over the fitting, along the gas spring, and across the awning knuckle engaging the hook.

2. A lateral arm actuator according to claim 1, wherein the rod is biased toward an extended position.

3. A lateral arm actuator according to claim 1, wherein the fitting comprises a groove, and wherein the cable is disposed in the groove.

4. A lateral arm actuator according to claim 1, wherein the cable is inelastic.

5. A lateral arm actuator according to claim 1, wherein the second connector is pivotable relative to the first connector across about 165°.

6. An extendable awning assembly comprising:

a motorized roller;

an extension bar;

an awning secured between the motorized roller and the extension bar; and an extension arm assembly coupled with the extension bar, the extension arm assembly including a first pivot arm pivotably connected to a second pivot arm and a lateral arm actuator disposed between the first and second pivot arms, the lateral arm actuator comprising:

a gas spring including a cylinder and a rod that is displaceable relative to the cylinder, a fitting disposed at a distal end of the rod, an awning knuckle including a first connector coupled to a cylinder end of the gas spring, a second connector, and a pivot coupled between the first and second connectors, wherein the second connector is pivotable relative to the first connector, and wherein the second connector includes a hook, and a cable formed into a continuous loop and positioned over the fitting, along the gas spring, and across the awning knuckle engaging the hook, wherein the first pivot arm is secured to the first connector of the lateral arm actuator assembly, and wherein the second pivot arm is secured to the second connector of the lateral arm actuator assembly.

7. An extendable awning assembly according to claim 6, comprising at least two extension arm assemblies acting on the extension bar.

8. An extendable awning assembly according to claim 7, further comprising a pair of base support brackets attachable to a structure, wherein the motorized roller is connected between the base support brackets, and wherein the first pivot arms of each of the extension arm assemblies is pivotably connected to a respective one of the base support brackets.

9. An extendable awning assembly according to claim 6, wherein the rod is biased toward an extended position.

10. An extendable awning assembly according to claim 9, wherein the extendable awning assembly is configured such that the awning in a stowed position maintains the extension arm assembly in a retracted position against the bias of the rod, and wherein the extendable awning assembly is further configured such that activation of the motorized roller in a first direction releases the awning, and the extension arm assembly is displaced toward an extended position by the bias of the rod.

11. An extendable awning assembly according to claim 10, wherein the extendable awning assembly is further configured such that activation of the motorized roller in a second direction opposite from the first direction draws the awning toward the retracted position against the bias of the rod.

12. An extendable awning assembly according to claim 6, wherein the fitting comprises a groove, and wherein the cable is disposed in the groove.

13. An extendable awning assembly according to claim 6, wherein the cable is inelastic.

14. An extendable awning assembly according to claim 6, wherein the second connector is pivotable relative to the first connector across about 165°.

* * * * *